US005264188A

United States Patent [19]

Lew

[11] Patent Number: 5,264,188

[45] Date of Patent: Nov. 23, 1993

[54] MULTI-STAGE HYDROTREATING PROCESS AND APPARATUS

[75] Inventor: Lawrence E. Lew, Bartlesville, Okla.

[73] Assignee: Phillips Petroleum Company, Bartlesville, Okla.

[21] Appl. No.: 955,790

[22] Filed: Oct. 2, 1992

Related U.S. Application Data

[62] Division of Ser. No. 643,252, Jan. 22, 1991, Pat. No. 5,176,820.

[51] Int. Cl.[5] ..... F28D 21/00

[52] U.S. Cl. ..... 422/208; 422/62; 422/109; 422/110; 422/111; 422/173; 208/211; 208/213

[58] Field of Search ..... 422/62, 108, 109, 110, 422/111, 112, 208, 173; 208/209, 210, 211, 213, 214, 251 R, 251 H

[56] References Cited

U.S. PATENT DOCUMENTS

| | | | |
|---|---|---|---|
| 3,472,759 | 10/1969 | Masologites et al. | 208/209 |
| 3,850,743 | 11/1974 | Peiser et al. | 208/209 |
| 3,979,183 | 9/1976 | Scott . | |
| 4,617,110 | 10/1986 | Hinojos et al. | 422/111 |
| 4,749,469 | 6/1988 | Beerbaum | 422/109 |

*Primary Examiner*—James C. Housel
*Assistant Examiner*—Krisanne M. Thornton
*Attorney, Agent, or Firm*—Charles W. Stewart

[57] ABSTRACT

Apparatus is provided whereby the heat released from exothermic hydrodemetallization reactions is recovered in order to provide either a lower operating cost of a two-stage hydrotreating process or protection of process equipment against excessive operating temperatures.

6 Claims, 1 Drawing Sheet

MULTI-STAGE HYDROTREATING PROCESS AND APPARATUS

This application is a Division of application Ser. No. 07/643,252, filed Jan. 22, 1991, now U.S. Pat. No. 5,176,820.

In one aspect, this invention relates to a process for treating hydrocarbon feed streams. In another aspect, this invention relates to a multi-stage process for hydrotreating a hydrocarbon feed stream that contains contaminating levels of metals and Ramsbottom carbon residue. In a further aspect, this invention relates to a multi-stage hydrotreating process having an improved energy efficiency and an improved process run length.

It is well known that crude oil, crude oil fractions and extracts of heavy crude oils, as well as products from extraction and/or liquefaction of coal and lignite, products from tar sands, products from shale oil and similar products may contain components which make processing difficult. As an example, when these hydrocarbon-containing feed streams contain metals such as vanadium, nickel and iron, such metals tend to concentrate in the heavier fractions such as the topped crude and residuum when these hydrocarbon-containing feed streams are fractionated. The presence of the metals make further processing of these heavier fractions difficult since the metals generally act as poisons for catalyst employed in processes such as catalytic cracking, hydrocracking, hydrogenation or hydrodesulfurization.

The presence of other components such as sulfur and nitrogen is also considered detrimental to the processability of a hydrocarbon-containing feed stream and also the presence of such components in products may violate environmental standards. Also, hydrocarbon-containing feed streams may contain components (referred to as Ramsbottom carbon residue) which are easily converted to coke in processes such as catalytic cracking, hydrogenation or hydrodesulfurization. It is thus desirable to remove components such as sulfur, nitrogen and components which have a tendency to produce coke.

Processes in which the above-described removals are accomplished are generally referred to as hydrotreating processes (one or all of the above-described removals may be accomplished in a hydrotreating process depending on the components contained in the hydrocarbon-containing feed stream).

In some hydrotreating processes, the removal of metals and components such as sulfur, nitrogen, and Ramsbottom carbon residue is accomplished in a single reactor. However, as has been previously stated, metals in particular tend to contaminate and deactivate catalysts which are particularly effective for hydrodesulfurization. Thus, two-stage processes are often used for hydrotreating.

In such two-stage hydrotreating processes, the first stage is predominantly utilized for demetallization. Because a demetallization catalyst is generally a less expensive catalyst than that used for desulfurization, the first-stage reactor system is often used as a guard reactor for removing metals that are detrimental to hydrodesulfurization catalyst. Effluent from the first reaction stage is then provided to a second reaction stage which is provided with a desulfurization catalyst that is somewhat more costly than demetallization catalyst and which is more sensitive to the presence of contaminating metals. Additionally, because desulfurization catalyst is often promoted with a metal such as cobalt, nickel and molybdenum, it is more active and therefore requires much lower contact temperatures than those required for the demetallization catalyst. Because of these differences between the demetallization catalyst and the desulfurization catalyst, it is economically preferential that a demetallization reaction stage be used prior to a desulfurization reaction stage with the purpose of removing metals which have the potential for poisoning the desulfurization catalyst in the second stage. As a result of this arrangement, the first reaction stage generally operates at a much higher temperature than those of the second reaction stage. Due to the first reaction stage operating at a higher temperature than the second reaction stage, it is desirable to reduce the temperature of the first reaction stage effluent prior to providing such effluent as a feed to the second reaction stage. Furthermore, because the amount of demetallization increases with increases in reaction temperature, it is sometimes preferable to increase the first reaction stage reaction temperature in order to provide an optimum removal of metals from the reactor effluent. As is commonly observed in the operation of hydrotreating processes, as the demetallization catalyst is deactivated due to such causes as metals adsorption and carbon laydown, the reaction temperature must be increased to compensate for the loss of catalyst activity.

The usual method for providing heat to the first-stage reactor feed is by the use of direct-fired furnaces. As is often experienced by operators of hydrotreating processes, the direct-fired heating of hydrocarbons results in the formation of coke deposits within the tubes of the fired heaters eventually resulting in large resistances to heat transfer to the process fluid thereby causing inefficient heat transfer. As is generally observed, the rate of coke deposition in the heater tubes increases with increases in heater temperature. Consequently, any requirements for increases in the first-stage reactor charge temperature results in an increase in the rate of coke deposition within the fired heater tubes due to the process requirements for greater reactor charge temperature. Eventually, because of the decreasing activity of the demetallization catalyst in the first reactor section, along with the concomitant increases in the fired heater temperature, the fired heater can prematurely reach its mechanical and process temperature limits resulting in the early shutdown of the process for decoking and catalyst replacement.

An additional difficulty encountered with a two-stage hydrotreating process is the exothermic nature of the demetallization and desulfurization reactions. Due to the combination of the higher operating temperature of the first stage and the exothermic heat of reaction, the first-stage reactor effluent that is fed to the second stage must be cooled prior to its contact with the desulfurization catalyst. By cooling the first-stage effluent, the hydrodesulfurization catalyst is protected from temperature excursions which may occur due to its higher activity.

It is thus an object of this invention to provide method and apparatus for cooling first-stage effluent of a demetallization reactor prior to such effluent being charged to a second-stage desulfurization reactor system.

It is also an object of this invention to provide method and apparatus for utilizing the heat of a reaction of the first-stage reactor for the purpose of providing a higher feed temperature to said reactor.

A yet further object of this invention is to provide method and apparatus for improving the run length of a hydrotreating process charge heater.

In accordance with the present invention, method and apparatus is provided whereby a hydrocarbon feed mixture is charged to furnace means for transferring heat energy to said hydrocarbon feed mixture to produce a heated hydrocarbon feed mixture. Heat energy is transferred by indirect heat exchange means from the hydrodemetallized hydrocarbon stream to the heated hydrocarbon feed mixture to produce a heated reactor charge stream and a cooled hydrodemetallized hydrocarbon stream. The heated reactor charge stream is contacted with hydrodemetallization catalyst to produce a hydrodemetallized hydrocarbon effluent stream followed by cooling and contacting of the hydrodemetallized hydrocarbon effluent stream with a hydrodesulfurization catalyst to produce a hydrodesulfurized hydrocarbon effluent stream.

Other aspects, objects and advantages of this invention will become apparent from the study of this disclosure, appended claims, and the drawing in which:

BRIEF DESCRIPTION OF THE DRAWING

Referring now to FIG. 1, a multi-stage hydrotreating system or two-stage hydrotreating system 10 is illustrated by schematic representation. Conduit 12 provides for fluid flow communication to inlet 14 of heat exchanger or first feed/effluent heat exchanger 16. In addition to inlet 14, heat exchanger 16 is provided with inlet 18, outlet 20 and outlet 22. Conduit 24 is operably connected between outlet 20 and inlet 26 of furnace or fired heater 28 for conveying fluid from heat exchanger 16 to fired heater 28. Fired heated 28 is also provided with inlet 30 and outlet 32.

Figure 1:
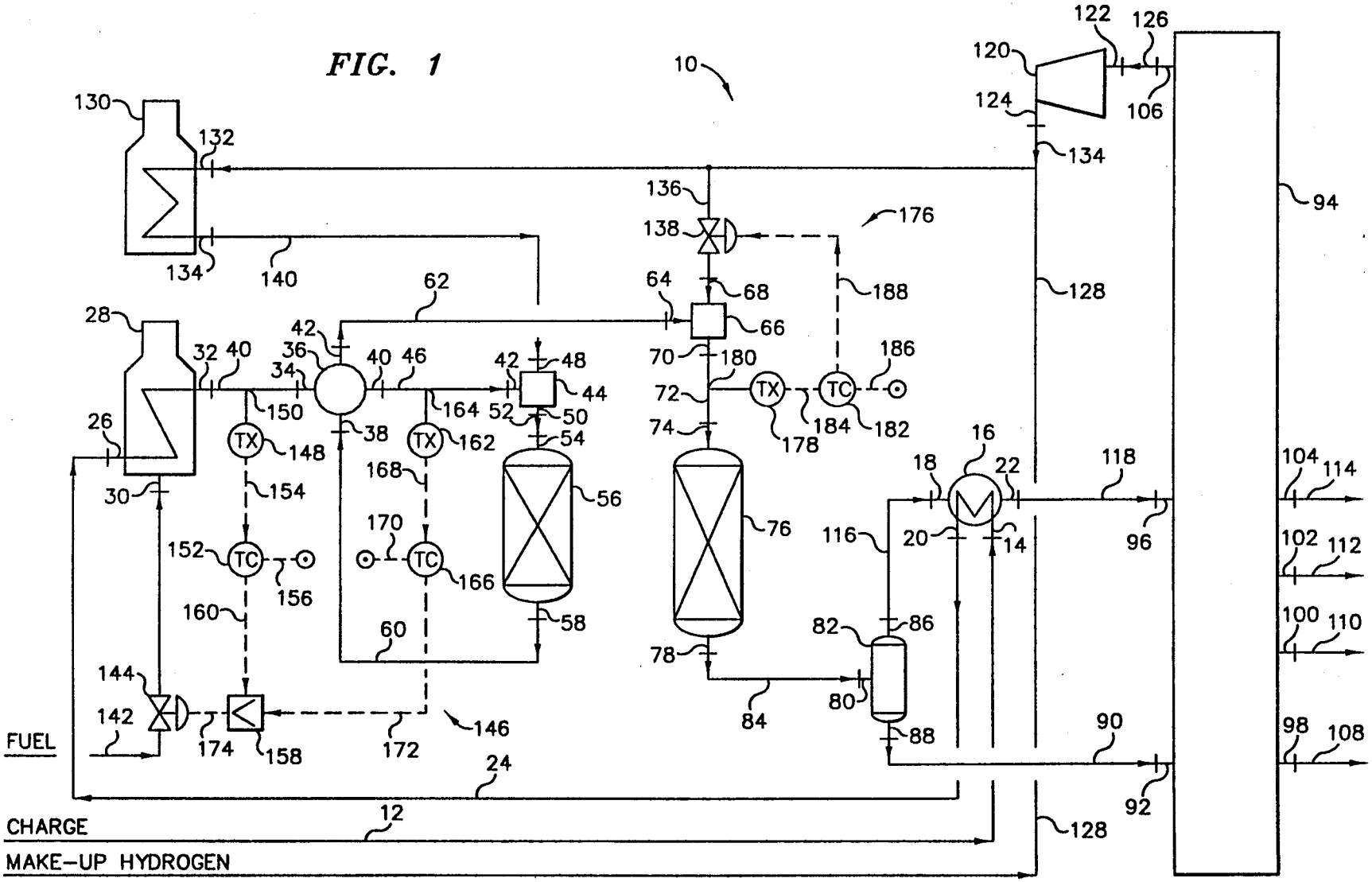
FIG. 1 is a schematic representation of a two-stage hydrotreating process and the associated control system of the present invention.

Providing for fluid flow communication between outlet 32 and inlet 34 of heat exchanger or second feed-/effluent heat exchanger 36 is conduit 40, which is operably connected between outlet 32 and inlet 34, for conveying fluid from fired heater 28 to heat exchanger 36. Heat exchanger 36 is additionally provided with inlet 38, outlet 40 and outlet 42. Operably connected between outlet 40 and inlet 42 of mixing device or first mixer 44 is conduit 46 for conveying fluid from heat exchanger 36 to mixing device 44. Mixing device 44 additionally is provided with inlet 48 and outlet 50.

Conduit 52 is operably connected between outlet 50 and inlet 54 of first reactor vessel or reactor vessel 56 for conveying fluid from mixing device 44 to reactor vessel 56. Reactor vessel 56 is also provided with an outlet 58. Operably connected between outlet 58 and inlet 38 is conduit 60 for conveying fluid from reactor vessel 56 to heat exchanger 36.

Conduit 62 is operably connected between outlet 42 and inlet 64 of mixing device or second mixer 66. Mixing device 66 is additionally provided with inlet 68 and outlet 70. Conduit 72 is operably connected between outlet 70 and inlet 74 of second reactor vessel or reactor vessel 76, which is also provided with outlet 78. Providing for fluid flow communication between outlet 78 and inlet 80 of first separator or phase separator or vessel 82 is conduit 84. First separator 82 is also provided with outlet 86 and outlet 88.

Conduit 90 is operably connected between outlet 88 and inlet 92 of separation system 94 for conveying fluid from first separator 82 to separation system 94. Separation system 94 can comprise any suitable arrangement of at least one separator for separating fluids into one or more fluid streams. Separation system 94 is additionally provided with inlet 96, outlet 98, outlet 100, outlet 102, outlet 104, and outlet 106. For conveying fluid from separation system 94 are conduits 108, 110, 112 and 114 which are operably connected to outlets 98, 100, 102 and 104, respectively. Conduit 116 is operably connected between outlet 86 and inlet 18 for conveying fluid from first separator 82 to heat exchanger 16. Operably connected between outlet 22 and inlet 96 is conduit 118 for conveying fluid from heat exchanger 16 to separator system 94. For conveying fluid from separation system 94 to recycle compressor 120, having an inlet 122 and an outlet 124, is conduit 126 which is operably connected between outlet 106 and inlet 122.

Conduit 128 is provided for conveying fluid to heat transfer device or heater or furnace 130, having an inlet 132 and an outlet 134, and which is operably connected to inlet 132. In fluid flow communication with conduit 128 is conduit 134 which is operably connected between outlet 124 and conduit 128 for conveying fluid from recycle compressor 120 to conduit 128. Also provided is conduit 136 which is in fluid flow communication with conduit 128 and is operably connected between conduit 128 and inlet 68 for conveying fluid from conduit 128 to mixing device 66. Interposed in conduit 136 is valve or control valve 138. Operably connected between outlet 134 and inlet 48 is conduit 140 for conveying fluid from heater 130 to mixing device 44. For providing fluid flow to furnace 28 is conduit 142, having interposed therein valve or control valve 144, and which is operably connected to inlet 30.

A first temperature control system 146 is provided for controlling the temperature of fluid flowing through conduit 40 and conduit 46. Provided is a first temperature transducer or temperature transducer 148 that is operably connected with a temperature-sensing device or sensor 150, which is operably located in conduit 40 for sensing the temperature of the fluid flowing in conduit 40. Operably connected between temperature transducer 148 and first temperature controller or temperature controller 152 is signal line 154 used to transmit a signal from temperature transducer 148 to temperature controller 152. Signal line 156 is operably connected to temperature controller 152 to provide for a signal input. To provide for an output signal from temperature controller 152 to low select switch 158 is signal line 160, which is operably connected between temperature controller 152 and low select switch 158. A further element of temperature control system 146 is second temperature transducer or temperature transducer 162 that is operably connected with temperature-sensing device or sensor 164, that is operably located in conduit 46 for sensing the temperature of the fluid flowing in conduit 46. Operably connected between temperature transducer 162 and temperature controller 166 is signal line 168 used to transmit a signal from temperature transducer 162 to temperature controller 166. Signal line 170 is operably connected to temperature controller 166 to provide for a signal input. To provide for an output signal from temperature controller 166 to low select switch 158 is signal line 172 which is operably connected between temperature controller 166 and low select switch 158. A signal line 174 is operably connected between control valve 144 and low select switch 158 to transmit an output signal from low select switch 158 to control valve 144.

A second temperature control system 176 is provided for controlling the temperature of fluid flowing through conduit 72. Provided is a third temperature transducer or temperature transducer 178 that is operably connected with temperature-sensing device or sensor 180, which is operably located in conduit 72, for sensing the temperature of the fluid flowing in conduit 72. Operably connected between temperature transducer 178 and temperature controller 182 is signal line 184 for transmitting a signal from temperature transducer 178 to temperature controller 182. Signal line 186 is operably connected to temperature controller 182 to provide for a signal input. Operably connected between temperature controller 182 and control valve 138 is signal line 188 for transmitting a signal from temperature controller 182 to control valve 138.

In operating multi-stage hydrotreating system 10, a hydrocarbon-containing feed stream or charge stock or charge having contaminating amounts of metal and sulfur compounds is fed to multi-stage hydrotreating system 10 via conduit 12. Any suitable hydrocarbon-containing feed stream can be provided through conduit 12 to the multi-stage hydrotreating system 10 illustrated in FIG. 1. Such suitable hydrocarbon-containing feed streams can include petroleum products, coal pyrolyzates, products from extraction and/or liquefaction of coal and lignite, products from tar sands, products from shale oil and similar products. Suitable hydrocarbon-containing feed streams obtained from petroleum products can include gas oil having a boiling range from about 390° F. to about 1000° F., topped crude having a boiling range in excess of about 640° F., and residuum. However, the present invention is particularly directed to heavy hydrocarbon feed streams such as heavy topped crudes and residuum and other materials which are generally regarded as being too heavy to be distilled. These materials will generally contain the highest concentrations of metals such as vanadium and nickel.

The hydrocarbon-containing feed stream passes by way of conduit 12 to first feed/effluent exchanger 16 which provides heat exchange means whereby the hydrocarbon-containing feed stream is heated by indirect heat transfer between the hydrocarbon-containing feed stream and the fluid stream passing to first/feed effluent exchanger 16 via conduit 116. A heated hydrocarbon-containing feed stream passes by way of conduit 24 to furnace 28 which defines a heating zone and provides means for heating the hydrocarbon-containing feed stream to the temperature levels necessary for downstream demetallization and desulfurization. Furnace 28 can be any suitable means for providing heat input or transferring heat energy into the heated hydrocarbon-containing feed stream; however, it is generally preferred that furnace 28 be of the direct-fired heater type of furnace. For proper demetallization or metals removal from the heated hydrocarbon-containing feed stream, it is generally desirable to heat the hydrocarbon-containing stream to the temperature range of from about 480° F. to about 1020° F. It is preferable, however, for the temperature range to be from about 660° F. to about 840° F. Generally, higher temperatures than those recited above provide for greater removal of metals from a hydrocarbon-containing feed stream, but temperatures greater than those recited usually have adverse effects on the heated hydrocarbon-containing feed stream and the associated equipment of multi-stage hydrotreating system 10. These adverse effects include, but are not limited to, such problems as excessive coking within the tubes of furnace 28, loss of catalyst activity due to coke laydown, excessive energy consumption, and equipment damage due to high operating temperatures. To avoid these problems, the outlet temperature of furnace 28 is limited to a maximum operating temperature of about 815° F. and preferably to a maximum operating temperature of 790° F. These temperature limits are generally set by the metallurgical limits of furnace 28 but can also be set by other factors such as feed characteristics and economics.

A heated hydrocarbon feed mixture exits furnace 28 through outlet 32 and passes by way of conduit 40 to second feed/effluent exchanger 36 which provides means for the indirect heat exchange or heat transfer between the heated hydrocarbon feed mixture and a reactor effluent stream passing by way of conduit 60 to second feed/effluent exchanger 36. In second feed/effluent exchanger 36, the temperature of the heated hydrocarbon feed mixture passing through conduit 40 to second feed/effluent exchanger 36 is increased to produce a heated reactor charge stream, by the indirect transfer of heat energy from reactor effluent stream or hydrodemetallized hydrocarbon stream leaving first reactor vessel 56. First reactor vessel 56 defines a first reaction zone or first reactor stage and provides means for contacting the heated reactor charge stream with a hydrodemetallization catalyst to produce a hydrodemetallized hydrocarbon stream or reactor effluent stream. The reactor effluent stream from first reactor vessel 56 is the heated reactor charge stream that has been contacted with hydrodemetallization catalyst contained in first reactor vessel 56 to produce the hydrodemetallized hydrocarbon stream or reactor effluent stream.

Because demetallization reactions are generally exothermic in nature and because the hydrodemetallization reactions take place in an essentially adiabatic environment, the reactor effluent stream from first reactor vessel 56 will have a substantially higher temperature than that of the heated reactor charge stream to first reactor vessel 56. Second feed/effluent heat exchanger 36 is provided to recover at least a portion of the heat released from the demetallization reactions, which take place in first reactor vessel 56, by means of indirect heat transfer. By placing second feed/effluent heat exchanger 36 in multi-stage hydrotreating system 10, the temperature of the heated reactor charge stream to first reactor vessel 56 can be significantly increased during situations where the outlet temperature of the heated hydrocarbon feed mixture from furnace 28 is limited by the mechanical and process limitations of furnace 28. In situations where the temperature limitations of furnace 28 have not been reached, second feed/effluent heat exchanger 36 serves to provide energy savings by recovering the heat of reaction released by the exothermic demetallization reactions that take place in first reactor vessel 56 to thereby allow for the reduction in the outlet temperature from furnace 28. This will result in a reduction in fuel demand of furnace 28 which is fed to furnace 28 via conduit 142.

First reactor vessel 56 can utilize any apparatus by which an intimate contact of a solid, inorganic refractory material with a heated hydrocarbon feed stream mixture and a free hydrogen-containing gas is achieved under such conditions to produce a hydrodemetallized hydrocarbon stream having reduced levels of contaminating metals. It is desirable to reduce the levels of all contaminating metals, but in particular, it is most desirable to reduce the levels of nickel and vanadium in the first reaction zone defined by first reactor vessel 56. Also, reduced levels of sulfur, nitrogen and Ramsbottom carbon residue and higher values of $API_{60}$ gravity may also be attained in the first reaction zone. The first reactor stage can be carried out using a fixed bed or a fluidized bed or a moving bed of the inorganic refractory material or an agitated slurry of the inorganic refractory material in the oil feed. The hydrodemetallization step can be carried out as a batch process or preferably as a continuous process. Preferably, a fixed bed of the inorganic refractory material is used in first reactor stage so as to eliminate the need of a step for separating the liquid intermediate product from the refractory inorganic material.

Any solid, inorganic refractory material that causes a reduction of the concentration of nickel and vanadium contained in the hydrocarbon-containing feed stream can be employed in the first reactor stage. Non-limiting examples of inorganic refractory materials that can be used in the first reactor stage are alumina, silica, magnesia, metal silicates, metal aluminates, aluminosilicates (e.g., clays), aluminum phosphate, and the like, and mixtures of two or more thereof. Alternating layers of different refractory materials can be used. The presently preferred inorganic refractory material is alumina, which more preferably has a surface area (BET/$N_2$;ASTM D3037) in the range of from about 10 to about 500 $m^2/g$, most preferably from about 50 to about 300 $m^2/g$, and a pore volume (determined by mercury intrusion at a pressure of about 15 Kpsig) in the range of from about 0.2 to about 2.0 cc/g.

The solid, substantially unpromoted inorganic refractory material is substantially free of metals belonging to Groups IVB, VB, VIB, VIIB, VIII, IB and IIB of the Periodic Table, i.e., the refractory material contains these metals at a combined level of less than about 25 weight percent, more preferably less than about 6 weight percent and most preferably less than 0.3 weight percent.

Prior to the feeding of a heated reactor charge stream to the first reactor stage, the heated reactor charge stream passing by way of conduit 46 is combined or mixed by mixing device 44, which defines a mixing zone and provides means for mixing a heated hydrogen stream passing through conduit 140 with heated reactor charged stream passing through conduit 46, with the heated reactor charge stream prior to contacting the resulting mixture with the hydrodemetallization catalyst contained in first reactor vessel 56. The heated hydrogen stream passing by way of conduit 140 is a combination of makeup hydrogen entering multi-stage hydrotreating system 10 via conduit 128 and recycle hydrogen from outlet 124 of recycle compressor 120 which enters conduit 128 via conduit 134. Recycle compressor 120 defines a compression zone and provides means for compressing a recycle hydrogen gas stream. The flow rate of makeup hydrogen entering multi-stage hydrotreating system 10 is substantially equal to the chemical hydrogen consumption due to the hydrotreating reactions, the hydrogen solubility losses, and mechanical process losses.

Any suitable flow rate of heated hydrogen stream can be employed in the first reactor stage of this invention. The flow rate of heated hydrogen stream to mixing device 44 can be such to give a ratio of hydrogen per barrel of heated reactor charge stream generally in the range of from about 100 to about 20,000 standard cubic feet (SCF) hydrogen per barrel of heated reactor charge stream. More preferably, however, the ratio of heated hydrogen stream and heated reactor charge stream will be in the range of from about 500 to about 6,000 SCF hydrogen per barrel of the heated reactor charge stream.

Any suitable reaction time, i.e., time of contact between the solid refractory inorganic material, the heated reactor charge stream and the heated hydrogen stream, can be utilized in the first reactor stage. In general, the reaction time will range from about 0.05 hours to about 10 hours. Preferably, the reaction time will range from about 0.4 to about 5 hours. Thus, the flow rate of the heated reactor charge stream should be such that the time required for the passage of the heated reactor charge stream through the first reaction zone (residence time) will be in the range of from about 0.05 to about 10 hours, preferably in the range of about 0.4 to about 5 hours. In a continuous fixed bed operation, this generally requires a liquid hourly space velocity (LHSV) in the range of from about 0.10 to about 20 volumes of heated reactor charge stream per volume of catalyst per hour. Preferably, LHSV will range from about 0.2 $hr^{-1}$ to about 2.5 $hr^{-1}$.

The hydrodemetallization reactions of the first reactor stage of the present invention can be carried out at any suitable temperature. The temperature will generally be in the range of about 480° F. to about 1020° F. and will preferably be in the range of about 660° F. to about 840° F. Higher temperatures do improve the removal of metals, but temperatures which will have adverse effects on the heated reactor charge stream, such as excessive coking, will usually be avoided. Also, economic considerations will usually be taken into account in selecting the operating temperature.

Any suitable pressure can be utilized in the first reactor stage. The reaction pressure will generally be in the range upwardly to about 5,000 pounds per square inch absolute (psia). Preferably, the pressure will be in the range of from about 100 to about 3000 psia. Higher pressures tend to reduce coke formation, but operating at high pressure may be undesirable for safety and economic reasons.

Preferably, the hydrodemetallization of first reactor stage is conducted at such conditions as to reduce the amount of nickel and vanadium present in the heated reactor charge stream by at least about 30 percent, more preferably by at least 50 percent. These metals (Ni, V) are preferably trapped by the solid inorganic refractory material, either by deposition on the surface (usually in combination with sulfur compounds and coke) and/or in the pores of the refractory material.

In general, the inorganic refractory material is utilized for demetallization in the first reaction zone until satisfactory levels of metals (Ni, V) removal is no longer achieved. Deactivation generally results from the coating of the inorganic refractory material with coke and metals removed from the feed. It is possible to remove the metals from the refractory material, but it is generally contemplated that once the removal of metals falls below a desired level, the spent or deactivated refractory material will simply be replaced by fresh catalyst.

The time in which the refractory material of this invention will maintain its activity for removal of metals will depend upon the metals concentration in the hydrocarbon-containing feed streams being treated. Generally, the inorganic refractory material can be used for a period of time long enough to accumulate from about 50 to about 200 weight percent of metals, which is mostly Ni and V, based on the initial weight of the inorganic refractory material, from the hydrocarbon-containing feed stream to multi-stage hydrotreating system 10. In other words, the weight of the spent inorganic refractory material will be from about 50 to about 200 percent higher than the weight of the fresh inorganic refractory material.

The reactor effluent stream from the first reactor stage generally will contain from about 2 to about 100 parts per million by weight (ppmw) nickel and from about 4 to about 200 ppmw vanadium. Preferably, the metals content of the reactor effluent stream will contain from about 2 to about 60 ppmw nickel and from about 4 to about 100 ppmw vanadium. The cooled reactor effluent, or cooled hydrodemetalized hydrocarbon stream exiting from second feed/effluent heat exchanger 36 passes by way of conduit 62 to mixing device 66 whereby a quench hydrogen stream passing by way of conduit 136 is mixed with the cooled reactor effluent from the first reactor stage passing by way of conduit 60, second feed/effluent heat exchanger 36, and conduit 62 to mixing device 66 prior to contacting the thus mixed quench hydrogen stream and cooled reactor effluent stream with a hydrodesulfurization catalyst contained in second reactor vessel 76. Mixing device 66 referred to herein defines a mixing zone and provides means for mixing the quench hydrogen stream passing through conduit 136 and the cooled reactor effluent passing through conduit 62 prior to contacting the thus formed mixture or cooled hydrodemetallized hydrocarbon stream with the hydrodesulfurization catalyst contained in the second reactor vessel 76. Second reactor vessel 76 defines a second reaction zone or second reactor stage and provides means for contacting the cooled hydrodemetallized hydrocarbon stream with a hydrodesulfurization catalyst to produce a hydrodesulfurized hydrocarbon effluent stream. The quench hydrogen stream is provided for temperature control of the cooled reactor effluent stream to the second reactor stage in order to provide additional temperature reductions not provided for by second feed/effluent heat exchanger 36. The mixture of the quench hydrogen stream and the cooled reactor effluent stream is contacted with the hydrodesulfurization catalyst of the second reactor stage.

The desulfurization catalyst composition of second reactor stage is used primarily to remove sulfur compounds from the reactor effluent stream from first reactor stage, but it also can be used to remove metals, nitrogen compounds and Ramsbottom carbon residue. The desulfurization catalyst generally comprises a support and a promoter. The support comprises alumina, silica or silica-alumina. Suitable supports are believed to be $Al_2O_3$, $SiO_2$, $Al_2O_3$—$SiO_2$, $Al_2O_3$—$TiO_2$, $Al_2O_3$—$P_2O_5$, $Al_2O_3$—$SnO_2$ and $Al_2O_3$—ZnO. Of these supports, $Al_2O_3$ is particularly preferred.

The preferred promoter comprises at least one metal selected from the group consisting of the metals of Group VIB, Group VIIB, and Group VIII of the Periodic Table. The promoter will generally be present in the catalyst composition in the form of an oxide or a sulfide. Particularly suitable promoters are iron, cobalt, nickel, tungsten, molybdenum, chromium, manganese, vanadium and platinum. Of these promoters, cobalt, nickel, molybdenum, vanadium and tungsten are the most preferred. A particularly preferred catalyst composition is $Al_2O_3$ promoted by CoO and $MoO_3$ or promoted by CoO, or promoted by NiO and $MoO_3$, or promoted by NiO and $MoO_3$.

Generally, such desulfurization catalysts are commercially available. The concentration of cobalt oxide in such catalysts is typically in the range of from about 0.5 weight percent to about 10 weight percent based on the weight of the total catalyst composition. The concentration of molybdenum oxide is generally in the range of from about 2 weight percent to about 25 weight percent based on the weight of the total catalyst composition. The concentration of nickel oxide in such catalysts is typically in the range of from about 0.3 weight percent to about 10 weight percent based on the weight of the total catalyst composition. Pertinent properties of four commercial catalysts which are believed to be suitable for use in the second reactor stage are set forth in Table I.

TABLE I

| Catalyst | CoO (Wt. %) | $MoO_3$ (Wt. %) | NiO (Wt. %) | Bulk Density* (g/cc) | Surface Area ($M^2/g$) |
|---|---|---|---|---|---|
| Shell 344 | 2.99 | 14.42 | — | 0.79 | 186 |
| Katalco 477 | 3.3 | 14.0 | — | 0.64 | 236 |
| KF - 742 | 4.3 | 15.5 | — | 0.73 | 260 |
| Commercial Catalyst D Harshaw Chemical Company | 0.92 | 7.3 | 0.53 | — | 178 |

*Measured on 20/40 mesh particles, compacted.

The desulfurization catalyst composition can have any suitable surface area and pore volume. In general, the surface area will be in the range of from about 2 to about 400 $m^2/g$, while the pore volume will be in the range of from 0.1 to 4.0 cc/g, preferably from about 0.3 to about 1.5 cc/g.

The cooled hydrodemetallized hydrocarbon stream is charged to second reactor vessel 76, which contains the above-described desulfurization catalyst composition, via conduit 72. The desulfurization that takes place in the second reactor stage defined by second reactor vessel 76 can be carried out by means of any apparatus whereby there is achieved a contact of the desulfurization catalyst with the mixture of cooled reactor effluent and quench hydrogen stream under suitable desulfurization conditions. The desulfurization taking place within second reactor stage is in no way limited to the use of a particular apparatus but can be carried out using a fixed catalyst bed, a fluidized catalyst bed or a moving catalyst bed. It is presently preferred to use a fixed catalyst bed.

Any suitable reaction time between the desulfurization catalyst composition and the mixture of cooled reactor effluent and quench hydrogen or mixture stream can be utilized. In general, the reaction time will range from about 0.1 hours to about 10 hours. Preferably, the reaction time will range from about 0.4 to about 5 hours. Thus, the flow rate of the mixture should be such that the time required for its passage through the reactor (residence time) will preferably be in the range of from about 0.4 to about 4 hours. This generally requires a liquid hourly space velocity (LHSV) in the range of from about 0.10 to about 10 volumes of mixture per volumes of catalyst per hour, preferably from about 0.2 to about 2.5 $hr^{-1}$.

The desulfurization stage of the present invention can be carried out at any suitable temperature. The temperature will generally be in the range of from about 300° F. to about 1020° F. and will preferably be in the range of about 660° F. to about 840° F. Because desulfurization catalyst is generally more active than demetallization catalyst, it is usually desirable to operate the desulfurization stage at a lower reactor temperature than that used in the demetallization stage. Additionally, due to certain economic advantages, it is often preferable to operate the desulfurization stage at the lowest permissible temperature which will provide for the desired desulfurization.

Any suitable pressure can be utilized in the second reactor stage. The reaction pressure will generally range upwardly to about 5,000 psia. Preferably, the pressure will be in the range of from about 100 to about 2500 psia. Higher pressures tend to reduce coke formation but operation at high pressure can have adverse economic consequences.

A reactor effluent or desulfurized hydrocarbon effluent stream from the second reactor stage passes by way of conduit 84 to first separator 82 which defines a separation zone and provides means for separating the reactor effluent from second reactor stage into a first fluid and a second fluid. The first fluid primarily comprises hydrogen gas and hydrocarbon gas but at least a portion of said first fluid can be a liquid phase fluid. The second fluid is primarily a hydrocarbon in the liquid phase but at least a portion of said second fluid can be hydrogen or hydrocarbon in the gaseous phase. The first fluid passes by way of conduit 116 to first feed/effluent heat exchanger 16 whereby an indirect heat exchange is provided for cooling the first fluid and heating the hydrocarbon-containing stream entering multi-stage hydrotreating system 10 through conduit 12. The cooled first fluid passes by way of conduit 118 to separation system 94. The second fluid from first separator 82 passes by way of conduit 90 to separation system 94. Separation system 94 defines a separation zone and provides means for separating the first fluid and the second fluid into at least one substantially gaseous stream and into at least one substantially liquid stream. Preferably, within separation system 94, the first fluid and second fluid are further processed to produce a recycle hydrogen stream that is fed via conduit 126 to recycle compressor 120, which provides means by which the recycle hydrogen is fed to mixing device 66 and furnace 130, and other product streams that pass from separation system 94 by way of conduits 108, 110, 112, and 114.

To control the feed temperature to the first reactor stage and to prevent excessive hydrocarbon feed mixture temperatures, the heat released by furnace 28 is controlled by first temperature control system 146. Temperature transducer 148 in combination with sensor 150, which provided means for sensing temperatures of the fluid stream flowing in conduit 40, provides an output signal that is transmitted through signal line 154 and which is representative of the actual temperature of the heated hydrocarbon feed mixture flowing in conduit 40. The output signal transmitted through signal line 154 is provided as the process variable input to temperature control means provided by temperature controller 152.

Temperature controller 152 is also provided with a set point signal that is transmitted through signal line 156 and which is representative of the desired temperature of the heated hydrocarbon mixture flowing through conduit 40. Generally, the set point signal transmitted through signal line 156 will be known based on the maximum allowable operating temperature of furnace 28 so as to prevent excessive coking and mechanical failures due to high operating temperatures of furnace 28.

In response to signals transmitted through signal lines 154 and 156, temperature controller 152 provides an output signal that is transmitted through signal line 160, which is representative of the fuel flow rate to furnace 28 required to give a rate of energy release that must be provided by furnace 28 in order to maintain the actual temperature of the heated hydrocarbon mixture flowing through conduit 40 substantially equal to the desired temperature represented by the set point signal transmitted by signal line 156. The output signal from temperature controller 152 transmitted through signal line 160 is provided as a first input signal to low select switch 158.

Temperature transducer 162 in combination with sensor 164, provides an output signal transmitted through signal line 168 that is representative of the actual temperature of the heated reactor charge stream flowing through conduit 46. The output signal transmitted through signal line 168 is provided as the process variable input to temperature controller 166.

Temperature controller 166 is also provided with a set point signal transmitted by signal line 170 that is representative of the desired temperature of the heated reactor charge stream flowing through conduit 46. Generally, the set point signal transmitted through signal line 170 is known based on the activity of hydrodemetallization catalyst utilized in the first reactor stage, the desired operating conditions of the first reactor stage, and the particular type of hydrocarbon feed material being processed. In the typical operation of first reactor stage, the hydrodemetallization catalyst becomes deactivated through use due to the adsorption of metal contaminants and the laydown of coke. To compensate for this loss of demetallization activity, it is generally desirable to increase the temperature of the process feed to the first reaction stage. This is accomplished by changing the magnitude of set point signal transmitted through signal line 170 during the life of the demetallization catalyst so as to increase the temperature as desired and maintain a desired level of demetallization.

In response to the input signals transmitted to temperature controller 166 through signal lines 168 and 170, temperature controller 166 transmits an output signal through signal line 172, which is scaled so as to be representative of the fuel flow rate to furnace 28 required to give a rate of heat release that must be provided by furnace 28 in order to maintain the actual temperature of the heated reactor charge stream flowing through conduit 46 substantially equal to the desired temperature represented by the set point signal transmitted by signal line 170. The output signal is provided as a process input variable to low select switch 158. Low select switch 158 provides means for selecting the smaller of signals transmitted by signal lines 160 and 172 which serves as an output signal transmitted by signal line 174. The output signal is transmitted through signal line 174 and is provided as a control signal to control valve 144, which is manipulated to maintain the actual flow rate of the fuel passing through conduit 142 at a rate necessary to maintain a process fluid temperature substantially equal to the desired temperature of the process fluid flowing in either conduit 40 or conduit 46, whichever is lower.

In order to control the temperature of the cooled reactor effluent to the second reactor stage, quench hydrogen is provided for mixing with the cooled reactor effluent from the first reactor stage. Temperature transducer 178 in conjunction with sensor 180, provides an output signal transmitted through signal line 184 that is representative of the actual temperature of the quenched, cooled reactor effluent flowing through conduit 72. The output signal transmitted through signal line 184 is provided as a process variable input to temperature controller 182. Temperature controller 182 is also provided with a set point signal transmitted by signal line 186 that is representative of the desired temperature of quenched, cooled reactor effluent to be charged to the second reactor stage.

In response to the output signal transmitted by signal line 184 and set point signal transmitted by signal line 186, temperature controller 182 provides an output signal transmitted by signal line 188 that is responsive to the difference between the set point signal transmitted by signal line 186 and the signal transmitted by signal line 184. The output signal transmitted by signal line 188 is scaled so as to be representative of the flow rate of quench hydrogen passing through conduit 136 required to maintain the actual temperature of the quenched, cooled reactor effluent to be charged to the second reactor stage substantially equal to the desired temperature represented by set point signal transmitted through signal line 186. The output signal transmitted through signal line 188 is provided as a control signal from temperature controller 182 to control valve 138. Control valve 138 is manipulated in response to the output signal transmitted through signal line 188.

The specific control system configuration described above and as set forth in FIG. 1 are provided for the sake of illustration. However, the invention extends to different types of control system configurations which accomplish the purpose of the invention. Lines designated as signal lines in the drawing are electrical or pneumatic in this preferred embodiment. Generally, the signals provided from any transducer are electrical in form. However, the signals provided from flow sensors will generally be pneumatic in form.

The invention is also applicable to mechanical, hydraulic or other signal means for transmitting information. In almost all control systems some combination of electrical, pneumatic, mechanical or hydraulic signals will be used. However, use of any other type of signal transmission, compatible with the process and equipment in use, is within the scope of the invention.

The controllers shown may utilize the various modes of control such as proportional, proportional-integral, proportional-derivative, or proportional-integral-derivative. In this preferred embodiment, proportional-integral-derivative controllers are utilized but any controller capable of accepting two input signals and producing a scaled output signal, representative of a comparison of the two input signals, is within the scope of the invention.

The scaling of an output signal by a controller is well known in control system art. Essentially, the output of a controller may be scaled to represent any desired factor or variable. An example of this is where a desired flow rate and an actual flow rate is compared by a controller. The output could be a signal representative of a desired change in the flow rate of some gas necessary to make the desired and actual flows equal. On the other hand, the same output signal could be scaled to represent percentage or could be scaled to represent a temperature change required to make the desired and actual flows equal. If the controller output can range from 0 to 10 volts, which is typical, then the output signal could be scaled so that an output signal having a voltage level of 5.0 volts corresponds to 50 percent, some specified flow rate, or some specified temperature.

The various transducing means used to measure parameters which characterize the process and the various signals generated thereby may take a variety of forms or formats. For example, the control elements of the system can be implemented using electrical analog, digital electronic, pneumatic, hydraulic, mechanical or other similar types of equipment or combinations of one or more such equipment types. While the presently preferred embodiment of the invention preferably utilizes a combination of pneumatic final control elements in conjunction with electrical analog signal handling and translation apparatus, the apparatus and method of the invention can be implemented using a variety of specific equipment available to an understood by those skilled in the process control art. Likewise, the format of the various signals can be modified substantially in order to accommodate signal format requirements of the particular installation, safety factors, the physical characteristics of the measuring or control instruments and other similar factors. For example, a new flow measurement signal produced by a differential pressure orifice flow meter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameter. Regardless of the signal format or the exact relationship of the signal to the parameter which it represents, each signal representative of a measured process parameter or representative of a desired process value will bear a relationship to the measured parameter or desired value which permits designation of a specific measured or desired value by a specific signal value. A signal which is representative of a process measurement or desired process value is therefore one from which the information regarding the measured or desired value can be readily retrieved regardless of the exact mathematical relationship between the signal units and the measured or desired process units.

By the utilization of the invention as described hereinabove, a hydrotreating charge furnace can be protected from excessive coking caused by high operating temperatures. Furthermore, energy utilization can be improved in certain situations by recovering the heat of reaction that results from the demetallization reactions of the first stage of a two-stage hydrotreating process. This heat of reaction is recovered by passing the first reaction stage or demetallization stage effluent through a feed effluent exchanger. The recovery of this heat permits the reduction in the amount of heat energy that must be released by the hydrotreating process charge heater and can reduce the volume of quench hydrogen required for cooling the feed to the second reactor stage. Additionally, improvements in the amount of demetallization can be achieved through operating a hydrodemetallization reaction stage at higher reaction temperatures, which are associated with improved metals removal. These benefits result also in protecting the desulfurization catalyst of the second reaction stage. With the feedstock charged to the desulfurization stage having lower metals content and flowing at lower temperatures, the useful life of the desulfurization catalyst can be improved. The combination of extended run lengths and improved energy recovery results in lower operating costs of a two-stage hydrotreating process.

While this invention has been described in detail for purposes of illustration, it is not to be construed as limited thereby but is intended to include all reasonable variations and modifications within the scope and spirit of the described invention and the appended claims.

That which is claimed is:

1. A hydrotreating apparatus comprising:

furnace means for transferring heat energy into a hydrocarbon-containing feed stream to produce a heated hydrocarbon feed mixture;

first conduit means, in fluid flow communication with said furnace means, for charging said hydrocarbon-containing feed to said furnace means first heat exchanger means, operably connected in said first conduit, for transferring heat energy to said hydrocarbon-containing feed stream, prior to charging said hydrocarbon-containing feed stream to said furnace means;

second heat exchanger means for transferring heat energy from a hydrodemetallized hydrocarbon stream to said heated hydrocarbon feed mixture by indirect heat exchange to produce a heated reactor charge stream and a cooled hydrodemetallized hydrocarbon stream;

second conduit means, operably connected between said furnace means and said second heat exchanger means, for conveying said heated hydrocarbon feed mixture to said second heat exchanger means;

first reactor means for contacting said heated reactor charge stream with a hydrodemetallization catalyst to produce a hydrodemetallized hydrocarbon stream;

third conduit means, operably connected between said second heat exchanger means and said first reactor means, for conveying said heated reactor charge stream to said first reactor means;

fourth conduit means, operably connected between said first reactor means and said second heat exchanger means, for conveying said hydrodemetallized hydrocarbon stream to said second heat exchanger means;

second reactor means for contacting said cooled hydrodemetallized hydrocarbon stream with a hydrodesulfurization catalyst to produce a hydrodesulfurized hydrocarbon effluent stream; and fifth conduit means, operably connected between said second reactor means and said second heat exchanger means, for conveying said cooled hydrodemetallized hydrocarbon stream to said second reactor means.

2. An apparatus as recited in claim 1, further comprising:

first separation means for separating said hydrodesulfurized hydrocarbon effluent stream into a first fluid and a second fluid;

sixth conduit means, operably connected between said second reactor means and said first separation means, for conveying said hydrodesulfurized hydrocarbon effluent stream to said first separation means, seventh conduit means, operably connected between said first separation means and said first heat exchanger means, for conveying said first fluid to said first heat exchange means so as to provide said first fluid to said first heat exchanger means for transferring heat energy from said first fluid to said hydrocarbon-containing feed stream.

3. An apparatus as recited in claim 2, further comprising:

first mixing means interposed in said third conduit means for mixing a heated hydrogen stream with said heated reactor charge stream to form a mixture for contacting with said hydrodemetallization catalyst in said first reactor;

eighth conduit means, in fluid flow communication with said first mixing means, for conveying said heated hydrogen stream to said first mixing means;

second mixing means, interposed in said fifth conduit means, for mixing a quench hydrogen stream with said cooled hydrodemetallized hydrocarbon stream to form a mixture for contacting with said hydrodesulfurization catalyst in said second reactor; and ninth conduit means, in fluid flow communication with said second mixing means, for conveying said quench hydrogen stream to said second mixing means; and first control valve means, interposed in said ninth conduit means, for manipulating the flow of said quench hydrogen stream so as to control the rate at which said quench hydrogen stream is mixed with said cooled hydrodemetallized hydrocarbon stream to thereby maintain said cooled hydrodemetallized hydrocarbon stream at a desired temperature.

4. An apparatus as recited in claim 3 wherein said furnace means is provided with burner means for combustion of a fuel to supply heat energy to said furnace means further comprising:

tenth conduit means, in fluid flow communication with said burner means, for providing said fuel to said burner means; and second control valve means, interposed in said tenth conduit means, for manipulating the flow of said fuel to maintain said heated reactor charge stream at a desired temperature thereby to maintain said heated hydrocarbon feed mixture at a desired temperature.

5. An apparatus as recited in claim 4, further comprising:

first control means, operably connected in said second conduit means, for establishing a first signal representative of the actual temperature of said heated hydrocarbon feed mixture passing through said second conduit means;

second control means, operably connected to said first control means, for establishing a second signal representative of the desired temperature of said heated hydrocarbon feed mixture passing through said second conduit means;

third control means, operably connected to said first and second control means, for comparing said first signal and said second signal and for establishing a third signal which is responsive to the difference between said first signal and said second signal and for scaling said third signal so as to be representative of the fuel flow rate through said tenth conduit means required to maintain the actual temperature of said heated hydrocarbon mixture substantially equal to the desired temperature represented by said second signal;

fourth control means, operably connected in said third conduit means, for establishing a fourth signal representative of the actual of said heated reactor charge stream passing through said third conduit means;

fifth control means, operably connected to said fourth control means, for establishing a fifth signal representative of the desired temperature of said heated reactor charge stream passing through said third conduit means;

sixth control means, operably connected to said fourth and fifth control means, for comparing said fourth signal and said fifth signal and establishing a sixth signal which is responsive to the difference between said fourth signal and said fifth signal and for scaling said sixth signal so as to be representative of the fuel flow rate through the tenth conduit means required to maintain the actual temperature of said heated reactor charge stream substantially equal to the desired temperature represented by said fifth signal;

seventh control means, operably connected to said third control means and said sixth control means, for selecting the smaller of said third and said sixth signal to serve thereby as a seventh signal; and eighth control means, operably connected between said seventh control means and second control valve means, for manipulating said second control valve means in response to said seventh signal.

6. An apparatus as recited in claim 5, further comprising:

ninth control means, operably connected in said ninth conduit means, for establishing an eighth signal representative of the actual temperature in said fifth conduit means of the mixture of said quench hydrogen stream and said hydrodemetallized hydrocarbon stream;

tenth control means, operably connected to said ninth control means, for establishing a ninth signal representative of the desired temperature in said fifth conduit means of the mixture of said quench hydrogen stream and said hydrodemetallized hydrocarbon stream;

eleventh control means, operably connected to said ninth and tenth control means, for comparing said eighth signal and said ninth signal and for establishing a tenth signal which is responsive to the difference between said eighth signal and said ninth signal and for scaling said tenth signal so as to be representative of the flow rate of said quench hydrogen passing through said ninth conduit means required to maintain the actual temperature of the mixture of said quench hydrogen stream and said hydrodemetallized hydrocarbon stream passing through said fifth conduit means substantially equal to the desired temperature represented by said ninth signal; and twelfth control means operably connected between said eleventh control means and said first control valve, for manipulating said first control valve means in response to said tenth signal.

* * * * *